United States Patent [19]

Brandstadter

[11] 4,308,720

[45] Jan. 5, 1982

[54] LINEAR ENGINE/HYDRAULIC PUMP

[75] Inventor: Jack M. Brandstadter, Royal Oak, Mich.

[73] Assignee: Pneumo Corporation, Boston, Mass.

[21] Appl. No.: 93,371

[22] Filed: Nov. 13, 1979

[51] Int. Cl.[3] ..... F02B 71/04

[52] U.S. Cl. ..... 60/595; 60/596; 123/46 R; 417/11; 417/380

[58] Field of Search ..... 417/11, 364, 380, 340, 417/341, 342, 299; 60/597, 606, 596, 595, DIG 1; 123/41.49, 46 R

[56] References Cited

U.S. PATENT DOCUMENTS

| | | | |
|---|---|---|---|
| 1,277,735 | 9/1918 | LaPorte | 60/597 |
| 2,600,251 | 6/1952 | Lewis et al. | 417/11 |
| 2,754,654 | 7/1956 | Kholucy | 417/11 |
| 3,119,230 | 1/1964 | Kosoff | 60/595 |
| 3,199,456 | 8/1965 | Wachsmuth | 417/11 |
| 3,522,999 | 8/1970 | Liles | 417/299 X |
| 3,990,242 | 11/1976 | Muller | 60/597 |

FOREIGN PATENT DOCUMENTS

| | | | |
|---|---|---|---|
| 678944 | 9/1952 | United Kingdom | 60/606 |
| 806369 | 12/1958 | United Kingdom | 60/597 |

*Primary Examiner*—Carlton R. Croyle
*Assistant Examiner*—Edward Look
*Attorney, Agent, or Firm*—Maky, Renner, Otto & Boisselle

[57] ABSTRACT

A linear engine/hydraulic pump system provides an efficient source of controllable fluid power thay may be used for a hydrostatic drive system of a vehicle. The engine/pump has a prompt first stroke full power capability and capability of prompt power increase from a lower power operation. A supplemental engine (bounce engine) produces output work to operate the power engine of the free piston engine pump during a compression stroke of the latter. The engine is of the opposed piston type with a synchronizer and cross drive to maintain controlled interrelated operational movement of the two oppositely moving pistons thereof while combining output work effort and holding approximately constant the approximate center of mass of the engine. A novel starter also is disclosed.

19 Claims, 4 Drawing Figures

LINEAR ENGINE/HYDRAULIC PUMP

BACKGROUND OF THE INVENTION

The present invention relates generally, as indicated, to improvements in engines and, more particularly, to linear engine/hydraulic pumps. Linear engines are well known and typically include a piston movable in an engine cylinder in response to internal combustion occurring in the latter and means for removing output work from the piston during its power stroke. In particular, such output work is removed substantially directly from the linearly moving piston without conversion through a crankshaft to rotary motion and then, for example, back to linear motion, say to operate a pump. The combination of a linear engine/hydraulic pump as a substantially integral unit also is a known device in which output work from the linear engine directly operates one or more pump pistons that pump fluid received at relatively low pressure to a relatively high pressure fluid output, say to provide hydraulic work input to a hydraulic motor.

To provide motive power for heavy duty vehicles, such as an armored combat vehicle, conventional relatively heavy duty engines, i.e. of the type that produce a rotary output force, and transmissions have been used. In the past hydrostatic transmissions have been evaluated for use in such heavy duty vehicles, but the relatively low efficiency associated with a variable displacement pump and motor combination driven by a conventional engine, which produces a rotary output, has precluded such use. In the past the inherent advantages of hydrostatic systems have been more than offset in the negative by the larger quantities of fuel and the larger cooling systems required in the vehicle in comparison to the requirements of a conventional engine and transmission for providing motive power thereto.

SUMMARY OF THE INVENTION

The present invention relates generally to a linear engine and, particularly, to a linear engine/hydraulic pump system that provides an efficient source of controllable fluid power that may be used for a hydrostatic drive system, such as the steer and drive system, of a vehicle, such as an armored combat vehicle. As used to provide a source of power for such a vehicle, the engine/pump system of the present invention in combination, for example, with variable displacement drive motors and appropriate controls provides an improved steer and drive system having reduced volume under armor, modular packaging, redundancy, relatively low cost and weight, ability to improve vehicle performance, and efficiencies, one or more of which may be generally comparable to those of conventional engines and transmissions.

One feature of the invention relates to the use of a supplemental engine (bounce engine) for producing output work to operate the power engine of the linear engine pump during a compression stroke of the latter. A number of advantages inure to this feature, such as the improved pumping efficiency, since high pressure hydraulic fluid need not be used to provide a work input to the engine during the compression stroke; and the compression ratio and cycle frequency of the power engine may be conveniently and efficiently controlled by controlling the cycle frequency and power of the supplemental engine.

According to another aspect of the invention a linear engine of the opposed piston type includes a synchronizing arrangement to maintain controlled interrelated operational movement of the two oppositely moving pistons thereof while holding approximately constant the approximate center of mass of the engine.

Still another aspect of the invention uses a work combining mechanism to combine the output work from two oppositely moving pistons of a free piston engine pump of the opposed piston type, with such combined output work being directed to a pump for pumping fluid.

Yet another aspect of the invention relates to a starter mechanism for a linear engine. According to one feature of such starter mechanism, work is delivered by the starter to one piston of an opposed piston type linear engine during one of the power and compression strokes to move that one piston in its cylinder to prepare the engine for operation in the succeeding respective power or compression stroke, and a work transfer means transfers to the other piston at least some of the work delivered from the starter means during the starting portion of a cycle. Another feature of the starter mechanism when the linear engine is used in combination with a pump employs a disabling means for disabling pumping of fluid to a relatively high pressure fluid output during at least part of the time that the start mechanism is operative to start the linear engine to reduce the input work required for starting.

Conventional and other engine/transmissions require an appreciable time to develop full power from an engine off, an idle, or a reduced power setting. This period of time limits the lateral and longitudinal acceleration and thereby the agility of the vehicle in which the engine/transmission is installed. An important feature of the present invention is the use of an integral linear compressor which permits the engine/pump to deliver maximum power on a first or subsequent power stroke.

In the past the engine has provided both the power for the compressor and the power for cooling and auxiliary functions associated with the engine and/or vehicle and the exhaust provided the power for the supercharger. However, further to complement the indicated prompt first stroke maximum power capability, the primary engine function of providing power for the compressor is separated from the secondary functions of providing power for cooling and auxiliary functions, with such secondary functions as well as the supercharger being powered from the exhaust system.

Thus, another aspect of the invention relates to prompt first stroke power output capability of the engine/pump and still another associated aspect relates to use of the energy of the exhaust product of combustion from a linear engine to provide a drive for engine cooling and/or other vehicle accessory systems.

With the foregoing in mind, primary objects of the invention are to provide a linear engine and a linear engine/hydraulic pump that are improved in the noted respects.

Another object is to provide a high efficiency in converting the chemical energy in fuel to fluid energy in an engine/pump system.

An additional object is to facilitate control of an engine/pump over a broad range such that the resultant variation in a pump output pressure and flow permits a variable displacement motor to operate at or near full displacement the majority of the time, thus resulting in improved efficiency of the motor operation.

A further object is to minimize the number of controls and the complexity thereof for start, run and stop functions of an engine pump system.

Still another object is to minimize the complexity of an engine/pump and, as corollaries thereto, to increase the reliability and to reduce the cost of such an engine/-pump and/or associated equipment.

Still an additional object is to provide in combination with an engine/pump a turbofan and a linear compressor that can supercharge the engine, cool the same, and provide a drive for vehicle accessory systems.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENT

Figure 1:
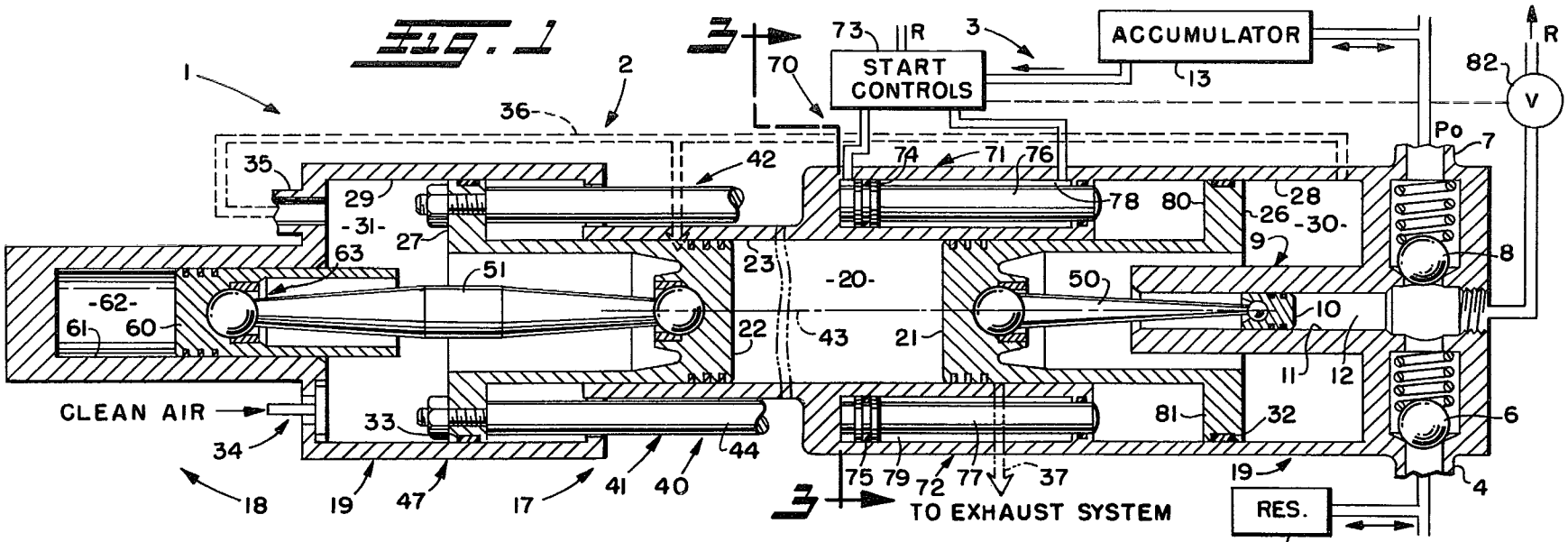
FIG. 1 is a schematic section view of a linear engine/-hydraulic pump embodying the features of the present invention.

Referring now in detail to the drawings, wherein like reference numerals designate like parts in the several figures, and initially to FIG. 1, a linear engine/hydraulic pump in accordance with the present invention is generally indicated at 1 having an engine portion 2 and a pump portion 3. The principal purpose of the engine 2 is to generate a work output that is transferred by the pump 3 to a hydraulic fluid, the pressure and flow rate of which is raised by the pump.

Briefly, the pump 3 has a fluid inlet 4, which receives fluid from an external fluid source, not shown, for example, a relatively low pressure fluid reservoir 5 via a conventional check valve 6; a pump outlet 7, which is isolated in one flow direction by a further conventional outlet check valve 8; and an active pumping assembly 9, which in the preferred embodiment is in the form of a pump piston 10 that is reciprocated in a pump cylinder 11 in response to the work output from the engine 2. As the pump piston 10 is reciprocated, fluid alternately is drawn into the pumping chamber 12 from the fluid inlet 4 past the inlet check valve 6 and is pumped at a pressure and flow rate depending on work output from the engine 2 past the outlet check valve 8 to the pump outlet 7. The relatively high pressure fluid output delivered to the pump outlet 7 may be coupled to an external fluid system, such as a variable displacement hydrostatic motor of a vehicle to provide motive power for the same and/or to operate various fluid systems of the vehicle. The fluid output also may be delivered to a high pressure fluid accumulator 13 commonly used in hydraulic systems for storing high pressure hydraulic fluid.

The engine portion 2 of the linear engine/hydraulic pump 1 includes a power engine 17 of the free piston type and a supplemental or bounce engine 18, also of the free piston type. In the power engine 17 the energy of internal combustion occurring in the power engine combustion chamber 20 is converted to output work by the driving movement of the opposed power pistons 21, 22 in the power engine cylinder 23 during a power stroke in the expansion portion of the internal combustion cycle. During the compression portion or compression stroke of the internal combustion cycle, the bounce engine 18 may be utilized to provide a work input to the power engine 17. The initiating of internal combustion in each of the power engine 17 and bounce engine 18 may be by spark ignition, compression ignition, etc. Moreover, the power engine 17 preferably is self-supercharged by a compressor 19.

At the back end or back side of each power piston 21, 22, i.e. on the side thereof remote from the combustion chamber 20, is a respective compressor piston 26, 27 of the compressor 19. During each power stroke, the compressor pistons 26, 27 are moved in respective air compressing cylinders 28, 29 to compress air in respective air compressing chambers 30, 31 for supercharging the power engine 17. Plastic rings 32, 33 provide seals for the compressor pistons 26, 27 to minimize air leakage and facilitate their sliding in the air compressing cylinders 28, 29. Directly associated with each air compressing chamber 30, 31 is a separate clean air intake valve, such as the one illustrated at 34, which may be of the mechanically or electro-mechanically operated type or of the check valve type that permits the flow of clean air into the respective air compressing chambers 30, 31 during the compression stroke of the power engine 17. A compressed air outlet, such as the one illustrated at 35, from each air compressing chamber 30, 31 is coupled by an air flow path 36 to provide compressed air to the combustion chamber 20 for scavenging and fresh air charging purposes when the power pistons 21, 22 are at or near bottom dead center, i.e. their extreme position near the end of each power stroke. An important feature of the invention is that the compressors 19 are preferably integral with the engine pump; as is noted below, such compressors facilitate near instantaneous power increases of the engine/pump and starting to a full power operation in the first cycle. Also, the direct connection between the compressing chambers 30, 31 to the combustion chamber 20, preferably being valved by only one of the power pistons facilitates control of compressed scavenge air with minimum parts. An exhaust path 37 from the combustion chamber 20 permits exhausting or scavenging of the products of combustion from the combustion chamber 20 also at or near the end of each power stroke, as is typical in free piston engines. Preferably the scavenge air is delivered into the combustion chamber 20 and the combustion products removed from the latter through the cylinder 23 wall in a manner to provide through scavenging. Moreover, fuel may be injected into the power engine combustion chamber 20 by a conventional fuel injector usually at or near the time at which there is a high level, and preferably near maximum, compression in the combustion chamber 20, as is also typical in linear engines.

There are, of course, several types of linear engines, including the opposed piston type in which the best mode and preferred embodiment of the present invention is embodied. However, it will be appreciated that various features of the invention may be employed with other types of linear engines, including free piston engines, such as the single acting type in which the power piston is driven by internal combustion to produce a work output during the power stroke, say to pump hydraulic fluid, and the hydraulic fluid later provides a work input to the power piston during the compression stroke. Another type of linear engine is the double acting type having power pistons at opposite ends such that during the power stroke of one power piston it provides a useful work output and also provides a work input for the compression stroke of the other power piston, and vice versa.

A distinct advantage of opposed piston type linear engines over the single acting and double acting type is that by making the power piston assemblies, i.e. the respective power pistons 21, 22 and the correspondingly respective movable engine parts directly associated therewith, of approximately equal masses, or of particular directly proportional masses, the approximate center of mass of the engine, in particular relative to the engine housing, will remain approximately constant. Therefore, the amount of vibration, the unstabilizing effect, say on a vehicle, and other disadvantageous characteristics are eliminated or at least reduced without requiring additional mass balancing apparatus for the linear engine.

A disadvantage encountered by prior opposed piston type free piston engines has been the need for several duplicative subsystems, such as a separate subsystem to obtain a work output from each power piston, a separate subsystem to provide input work to each power piston during the compression stroke, and so on, which tended to make such free piston engines more like a pair of single acting linear engines sharing a common combustion chamber than an integrated linear engine system.

The preferred embodiment and best mode of the present invention provides an integrated opposed piston type linear engine in which the individual work output produced by each power piston 21, 22 is combined for delivery to the pump portion 3 of the engine/pump 1, input work for the compression stroke is delivered to both power pistons 21, 22 from a single bounce engine 18, and movement of the power pistons 21, 22 is directly synchronized further to optimize holding substantially constant the center of mass of the engine. Other features of such an integrated opposed piston type linear engine in accordance with the invention are the over-all simplifying, and, thus, improving, the necessary engine controls, the pump portion 3 or other work output utilizing or converting device, the compression work input delivering mechanism, and engine start and stop controls and/or actuators.

Figure 2:
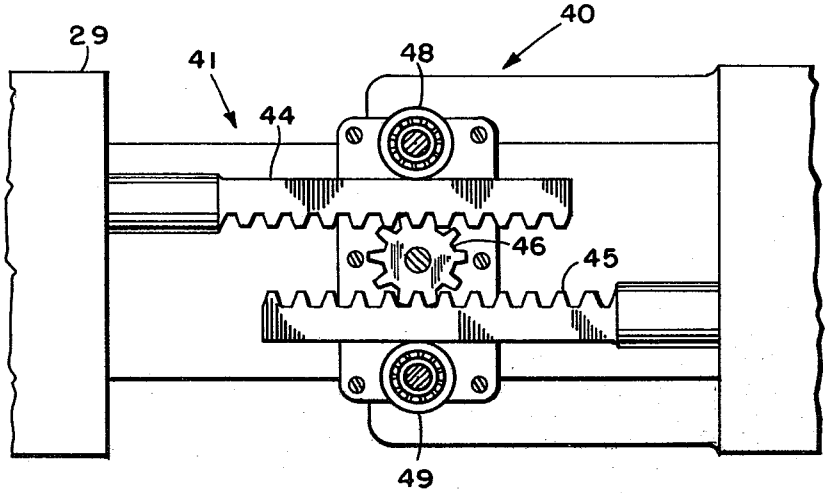
FIG. 2 is a schematic side elevation view illustrating the connecting mechanism between opposed power pistons of the engine/pump of FIG. 1.

The means for combining the individual work outputs from the power pistons 21, 22, for helping to deliver input work for compression to both of the power pistons 21, 22, and for synchronizing the motion of the power pistons 21, 22 is generally indicated as a synchronizer and cross drive 40 (hereinafter referred to as synchronizer) in FIG. 2. It is to be understood that the synchronizer 40 provides the output work combining, input work delivering, as well as the synchronizing and/or other functions jointly and/or severally.

Figure 3:
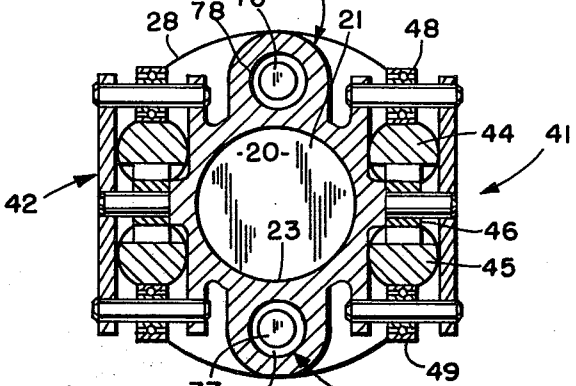
FIG. 3 is a section view through the engine/pump of FIG. 1 looking generally in the direction of the arrows 3—3 of FIG. 1.

The synchronizer 40 includes a pair of identical rack and pinion assemblies 41, 42 preferably located on diametrically opposite sides of the engine/pump 1, parallel to the linear axis 43 thereof, as is seen in FIG. 1. The rack and pinion assembly 41 illustratively shown in FIGS. 2 and 3 includes a pair of parallel synchronizer racks 44, 45 and a common pinion 46. Each rack 44, 45 is mechanically connected to a respective power piston 21, 22, for example as is illustrated at 47 (FIG. 1) to move linearly in common with the respective power piston. Bearings 48, 49 hold the racks 44, 45 parallel to each other and with the respective teeth thereof in engagement with respective teeth of the pinion 46. The mechanical synchronizer 40 has a high mechanical strength and efficiency. As one of the power pistons 21, 22 moves in the power engine cylinder 23 the other power piston will be constrained to move synchronously and in an opposite direction with respect to the first due to the synchronizing function of the synchronizer 40. Thus, the synchronizer 40 maintains the timing of movement of the opposed power pistons 21, 22.

Moreover, through the synchronizer 40 the individual work output produced by the power piston 22 during a power stroke is transferred to and/or combined with that of the power piston 21; the latter, in turn, is connected by a piston rod 50 directly to the pump piston 10 to apply such combined work output thereto to pump fluid, as aforesaid. Also, if desired, input work may be delivered to the pump piston 10 from the associated fluid system during the compression stroke of the power engine 17, and that input work, although coupled directly by the piston rod 50 to the power piston 21, is divided and delivered by the synchronizer 40 also to the power piston 22.

However, in accordance with the preferred embodiment and best mode of the present invention such input work for the compression stroke of the power engine 17 is provided by the bounce engine 18 via a further piston rod 51, which is coupled directly to the power piston 22; and the synchronizer 40 effectively divides such input work and effects substantially balanced delivery of the same also to the power piston 21.

The bounce engine 18 includes a bounce engine piston 60 movable in a bounce engine cylinder 61 and defining in combination with the latter a bounce engine combustion chamber 62. The bounce engine piston 60 is connected to the piston rod 51 preferably by a ball swivel connection 63, which may be of the same type preferably used for the power pistons, 21, 22 to respective piston rods. It will be appreciated that the bounce engine 18 operates like a single acting free piston engine and to that end has appropriate fuel and scavenge air inlets and an exhaust outlet, not shown. In the bounce engine the scavenge air inlet and exhaust oulet preferably are located in the cylinder 61 to provide loop scavenging and natural aspiration.

Preferably the power density capability and normal power density of the bounce engine 18 is comparatively low, especially in relation to the power density capability and normal power density of the power engine 17, which is of larger size and may be supercharged to optimize the operational efficiency thereof. By controlling the cycle frequency, i.e. the number of operational cycles per unit time, of the bounce engine 18, the cycle frequency of the power engine 17 is controlled since each power stroke of the bounce engine effects a compression stroke in the power engine. Moreover, by controlling the work output produced by the bounce engine 18, say by controlling the quantity of fuel and/or the time at which fuel is delivered into the bounce engine combustion chamber 62, the linear travel distance of the power pistons 21, 22 during a compression stroke and, thus, the effective compression ratio of the power engine 17 may be controlled, while allowing the other parameters, such as the quantity of fuel and its time of delivery to the power engine combustion chamber 20 to remain constant. Since the work output produced by the power engine 17 is a function of the compression ratio thereof, the flow rate at which fluid is pumped by the pump portion 3 of the engine/pump 1 may be controlled by effecting the aforementioned control of the bounce engine work output. The pressure of the fluid pumped to the fluid outlet 7 may be controlled by controlling the quantity of fuel injected into the power engine combustion chamber 20.

The hydraulic fluid pumped to the pump outlet 7 may be coupled to a variable displacement hydrostatic motor for providing the motive effort for a vehicle. It will be appreciated that such hydrostatic motor, then, may be operated much of the time at maximum or near maximum displacement, thereby optimizing the efficiency thereof, while controlling the flow rate of the fluid, preferably hydraulic fluid, pumped by the engine/pump 1 in the convenient manner described above, namely by controlling the fuel input and, thus, the work output of the bounce engine 18. The power of such hydrostatic motor may be controlled by controlling the fuel injected into the power engine combustion chamber and, therefore, the pressure of the fluid delivered to such motor.

The efficiency and reliability of the engine/pump 1 further is enhanced particularly by providing a very high mechanical efficiency and very high volumetric efficiency of the pump portion 3, which also is capable of operation at high pressure, being limited only by the pressure capability of the associated fluid system, the mechanical strength of the engine/pump 1, and, particularly, the load capability of the synchronizer and cross drive 40, which preferably is capable of operating at high loads. Since there are no substantial side loads applied to the various parts of the pump portion 3 and since there are no substantial seals required, the pump piston 10 preferably being a lap fit piston, the mechanical efficiency of the pump portion 3 is very high. Also, due to the few and relatively uncomplicated parts of the pump portion 3 it will experience relatively low leakage, if any; and this combined with the fact that the work input for the compression stroke of the power engine 17 preferably is not derived from the high pressure fluid output 7 provides for very high volumetric efficiency of the pump portion 3. Further contributing to the high volumetric efficiency of the pump portion 3 is the use of relatively low pressure fluid from the fluid inlet 4 to provide some bounce energy to the power engine 17 during the compression stroke while also filling the pumping chamber 12 and maintaining filled the pump cylinder 11.

A start mechanism 70 for starting the linear engine/-hydraulic pump 1 includes a pair of hydraulic starters or start actuators 71, 72 and start controls 73. The hydraulic starters 71, 72, respectively, include start pistons 74, 75 and rods 76, 77, which may be attached to or integral with the start pistons, movable in respective start cylinders 78, 79. The starters 71, 72 preferably are positioned on diametrically opposite sides of the power engine 18, say at 90° displacement about the axis 43 relative to the positions of the rack and pinion assemblies 41, 42 of the synchronizer and cross drive 40, as is illustrated in particular in FIG. 3. Thus, it will be appreciated that the approximate righthand half of the engine/pump 1 illustrated in FIG. 1 shows that portion of the engine/pump rotated approximately 90° about the axis 43 relative to the lefthand half of the illustration in FIG. 1.

Start controls 73 selectively apply hydraulic fluid pressure, for example stored in the accumulator 13 from prior operation of the engine/pump 1 or otherwise derived, simultaneously to the lefthand side of the start pistons 74, 75 driving the same to the right in the start cylinders 78, 79 to start an operational cycle of the engine/pump 1. The rods 76, 77, then, apply force to the surfaces 80, 81 of the power piston 21 driving the same toward a bottom dead center position, i.e. enlarging the power engine combustion chamber 20, while the synchronizer and cross drive 40 delivers force provided by the starters 71, 72 to the power piston 22 also moving the same toward its bottom dead center position. Alternatively, the start controls 73 may deliver fluid to the righthand side of the start pistons 74, 75 to withdraw the hydraulic starters 71, 72 into the start cylinders 78, 79 to the positions illustrated in 1. Ordinarily the start controls 73 would provide a return fluid path, say to the reservoir 5, from the respective side of the start pistons 74, 75 to which high pressure fluid is not being applied to facilitate movement of the starters 71, 72.

The start mechanism 70 simulates operation of the power engine 17 in a power stroke, i.e. during which the latter ordinarily would drive the pump portion 3, would compress air in the compressor 19, and would operate the bounce engine 18 in its compression stroke; except that such simulation is effected hydraulically preferably from stored energy in the associated fluid system and/or accumulator 13. Preferably during such simulated first half cycle, i.e. the power stroke, of the power engine 17 the pump portion 3 is effectively disabled. For example, to effect such disablement, the start controls 73 may operate an electromechanical valve 82 to dump fluid pumped by the pump piston 10 to the low pressure reservoir 5, thus reducing the size and power requirements of the start mechanism 70 and particularly the size of the start pistons 74, 75 and the fluid flow rates and pressures required to operate the same.

Hydraulic start mechanisms have been used in the past to start free piston engines; but typically the start force or input work for the first half cycle was delivered in a manner to effect compression in the power engine cylinder, thus requiring substantial input work to effect adequate compression for subsequent effective combustion in the engine combustion chamber. However, in the present invention the input work delivered by the start mechanism 70 during the first half cycle of the engine/pump 1 actually is used to effect a compression stroke in the relatively small, low power density bounce engine 18, which minimizes the amount of input work required for starting. Combustion in the bounce engine 18 during the second half cycle of the engine/pump 1, then, ordinarily will provide adequate input work to the power engine 17 for compression, combustion, and expansion in the latter during the next full cycle of operation of the engine/pump 1.

OPERATION OF THE FREE PISTON ENGINE/HYDRAULIC PUMP

Prior to starting the engine/pump 1, the power pistons 21, 22 ordinarily will be at or near inner (top) dead center position, i.e. with the power engine combustion chamber 20 being relatively minimum size. The start controls 73 then apply pressure to the hydraulic starters 71, 72 to cause outstroking thereof in a righthand direction. At the same time, the start controls 73 override the pump portion 3, for example by energizing the valve 82 to return the fluid displaced by the pump piston 10 to the low pressure reservoir 5. Movement of the power pistons 21, 22, then, in response to outstroking of the hydraulic starters 71, 72 compresses air in the air compressing chambers 30, 31 in readiness for delivery to the power engine combustion chamber 20 and, of course, also compresses air in the bounce engine combustion chamber 62, which preferably is naturally aspirated, since ordinarily it would be unnecessary to supercharge the bounce engine. At an appropriate time during outstroking of the hydraulic starters 71, 72 the power pistons 21, 22 will have been withdrawn sufficiently far to open the air flow path 36 from the air compressing chambers 30, 31 whereupon compressed air promptly is delivered to the power engine combustion chamber 20, and approximately at the same time, more or less, fuel is injected into the bounce engine combustion chamber 62 by means not shown. Also, the start controls 73 reverse the fluid connections of the hydraulic starters 71, 72 to withdraw the start pistons and rods into the start cylinders 78, 79. If desired, the righthand ends of the start cylinders 78, 79 may be vented, and the start controls 73 may simply connect relatively high pressure to the lefthand side of the start pistons 74, 75 to outstroke the starters 71, 72 and to connect the lefthand sides of the start pistons 74, 75 to relatively low return pressure, say to the reservoir 5, when it is desired to return the starters 71, 72 into the start cylinders 78, 79, which return is effected by the leftward moving power piston 21 during its compression stroke.

Internal combustion occurs in the bounce engine 18 driving the bounce engine piston 60 to the right in an expansion or power stroke effecting a compression stroke in the power engine 17 to compress air in the power engine combustion chamber 20. After the air flow path 36 is blocked via respective power piston(s) 21, 22 during such power engine compression stroke, the clean air intake valves, such as valve 34, are opened to recharge the air compressing chambers 30, 31, and the pumping chamber 12 is recharged with fluid from the fluid inlet 4. The pump portion 3 is enabled as by de-energizing the valve 82 to ready the pumping assembly 9 for pumping during the first power stroke of the power engine 17.

When the power pistons 21, 22 have been moved an adequate amount to obtain the desired compression in the power engine combustion chamber 20, fuel is injected into the combustion chamber 20, and combustion occurs to start the power stroke of the power engine 17. The pumping assembly 9 then pumps hydraulic fluid at high pressure to the pump outlet 7 while air in the bounce engine combustion chamber 62 is compressed as the power engine 17 undergoes its expansion or power stroke moving the bounce engine piston 60 to the left. Moreover, during such power stroke, the compressor pistons 26, 27 compress air in the air compressing chambers 30, 31 ready for supercharging the power engine 17 in the next cycle of operation thereof. Since the compressor 19 was able to provide compressed air to the power engine combustion chamber 20 during the initial cycle of operation of the power engine 17 upon starting thereof, the power engine will have capability to provide full power output during its first cycle. The power engine also has the same prompt response capability to obtain increased, even full, power output from a just prior operation at, say, idle or other reduced power opertion.

With the engine/pump 1 thus started, following the initial cycle of operation thereof, the engine/pump 1 is ready for continued running. The starters 71, 72 are maintained withdrawn. For each continuous subsequent cycle of operation of the engine/pump 1, then, fuel is injected into the bounce engine 18 causing combustion therein and, therefore, commencing of a compression stroke for the power engine 17. Air then is compressed in the power engine combustion chamber 20 while the air compressing chambers 30, 31 are recharged with clean air and the pumping chamber 12 is recharged with fluid from the fluid inlet 4. Fuel is then injected into the power engine combustion chamber 20, whereupon combustion occurs to commence the next power stroke of the power engine 17. Thereafter, hydraulic fluid is pumped to the pump outlet 7 while the compressor pistons 26, 27 compress air in the air compressor 19 and the bounce engine piston 60 compresses air in the bounce engine combustion chamber 62; and so forth.

During running operation of the linear engine/hydraulic pump 1, the amount of fuel injected into the power engine combustion chamber 20 may be varied to control the system output pressure, i.e. the maximum output pressure that can be imparted to the fluid at the pump outlet 7 by the pumping piston 10. Moreover, by varying the amount of fuel injected in the bounce engine combustion chamber 62, the compression ratio of the power engine 17, and, therefore, the flow rate of fluid delivered to the pump outlet 7 also can be controlled. The speed or cycle frequency, i.e. cycles per unit time, of the engine/pump 1 will be varied according to the output pressure required to be produced and encountered as a back pressure experienced by the pump piston 10 as it is exerting effort to pump fluid to pump outlet 7; such required or experienced pressure will effect automatic engine speed control such that at maximum encountered pressure, the engine speed will be maximum and at minimum encountered back pressure the engine speed will be minimum. The inertias of the power pistons 21, 22 and of the synchronizer and cross drive 40 also effectively store energy to produce a desired and relatively long lived pressure at varying flow during the power stroke of the power engine 17.

To stop the engine/pump 1, upon completion of a bounce stroke, i.e. the power stroke of the bounce engine 18 and the compression stroke of the power engine 17, fuel is not injected into the power engine combustion chamber 20. However, the air charge in the power engine combustion chamber 20 will expand somewhat until the external system pressure acting on the pump, i.e. resisting movement of the pumping piston 10, causes the engine/pump 1 to stall. Such stalling ordinarily will occur near inner dead center of the power pistons 21, 22.

Figure 4:
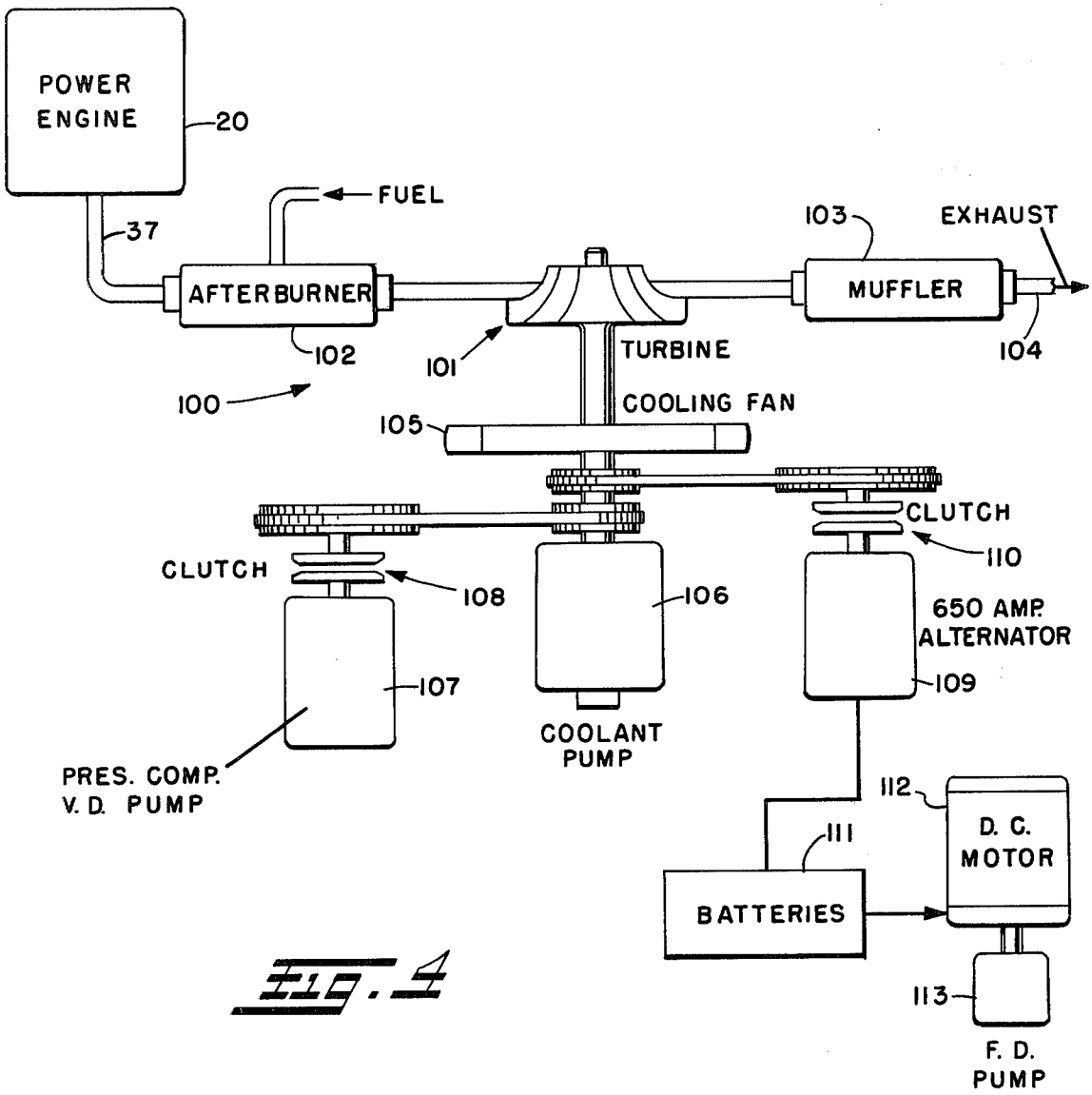
FIG. 4 is a schematic view of an exhaust utilization system of the engine/pump.

Turning now more particularly to FIG. 4, an exhaust utilization system for the linear engine/hydraulic pump 1 is schematically illustrated at 100. It is the purpose of the exhaust utilization system 100 both to provide a back pressure to the power engine combustion chamber 20 to permit through scavenged, two stroke cycle, piston diesel operation with adequate supercharging by the compressor 19. It is also the purpose of the exhaust utilization system 100 to provide operation of and power for operation of a cooling system for the linear engine/hydraulic pump 1 and/or auxiliary systems associated therewith and/or with a vehicle or the like in which the engine/pump is utilized.

The exhaust utilization system 100 is coupled to the exhaust path 37, which leads from the power engine combustion chamber 20, and primarily includes a turbine 101, which utilizes energy in the power engine exhaust to provide a supplemental work output to operate an engine/pump 1 cooling system and auxiliary hydraulic and electric systems. An afterburner 102 may be employed in the exhaust flow path 37 between the power engine combustion chamber 20 and the turbine 101 to use the oxygen-rich exhaust of the power engine 17 to provide extra turbine power, if desired. A muffler 103 and exhaust pipe 104 provide usual functions for expelling the final exhaust products of combustion from the turbine 101.

A cooling fan 105, for example directly driven by the turbine 101, as by mounting the fan on the turbine output shaft, may be utilized to pump or blow ambient air over a radiator, not shown, to cool the engine/pump 1, and a coolant pump 106 may pump coolant through a cooling system of the engine/pump 1 and the radiator, not shown, to provide liquid cooling for the engine/-pump. The coolant pump 106 also may be directly driven by the turbine output shaft, as is illustrated in FIG. 4.

A variable displacement pump 107 is belt driven by the turbine 101 and a clutch 108, which permits the turbine 101 to come up to speed before the clutch 108 is engaged, to provide fluid pressure for operating various hydraulic systems of, say, a vehicle in which the engine/pump 1 is employed. An electric alternator 109 also is belt driven by the turbine 101 via a clutch 110, which allows the turbine 101 to come up to speed before being engaged, to provide electrical energy for operating electrical systems of, say, the vehicle in which the engine/pump is used and to recharge the batteries 111 thereof. Coupled to the batteries 111 is a DC electric motor 112, which may be selectively energized to drive a fixed displacement pump 113 to provide hydraulic power for auxiliary systems in the vehicle, for example, when the engine/pump 1 is not operating and to provide hydraulic power for the hydraulic start mechanism 70 when adequate stored hydraulic energy for starting the engine/pump 1 is not available in the accumulator 13.

With the foregoing in mind it will be appreciated that the features of the invention may be employed in a linear engine/hydraulic pump for delivering a useful fluid work output, for example, to provide power for a vehicle.

The embodiments of the invention in which an exclusive property or privilege is claimed are defined as follows:

1. A linear engine pump, comprising pump means for pumping fluid, power engine means for producing output work to operate said pump means during a power stroke, and supplemental linear engine means for producing output work to operate said power engine means during a compression stroke of the latter, said power engine means comprising an engine cylinder, a pair of piston means movable in opposite directions in response to internal combustion for producing output work during a power stroke, work transfer means for transferring some of the work delivered to one of said piston means to the other of said piston means to move said other piston means in said cylinder in the opposite direction of movement of said one piston means, means for coupling output work directly only from said other piston means to said pump means for pumping fluid using the combined output work of said piston means transmitted to said pump means only through said other piston means, and means for coupling the remaining output work of said one piston means directly from said one piston means to said supplemental linear engine means during the power stroke of said power engine means and the compression stroke of said supplemental linear engine means, and for coupling output work from said supplemental linear engine means to said one piston means during the power stroke of said supplemental linear engine means.

2. The pump of claim 1, said supplemental linear engine means comprising a reciprocating piston, and said means for coupling the remaining output work of said one piston means to said supplemental linear engine means comprising a piston rod for connecting said reciprocating piston to said one piston means, said power engine means being larger and having a larger power density capability than said supplemental linear engine means.

3. The pump of claim 2, further comprising means for supercharging said power engine means.

4. The pump of claim 1, wherein said work combining means maintains controlled interrelated operational movement of each of said piston means to each other during simultaneous movement thereof in respective opposite directions in said cylinder while holding at least approximately constant the approximate center of mass of said power engine means.

5. The pump of claim 1, further comprising starter means for delivering work to said other piston means during a simulated power stroke of said power engine means to move said other piston means in said cylinder, said work transfer means being operative to transfer to said one piston means at least some of the work delivered to said other piston means to move said one piston means in said cylinder in the opposite direction of movement of said other piston means thereby to move said supplemental engine means in a simulated compression stroke to prepare the same for operation in its succeeding respective power stroke.

6. The pump of claim 5, wherein said pump means comprises a pump chamber, pump piston means for pumping fluid in said pump chamber, and connecting means for connecting said pump piston means and said other piston means to reciprocate said pump piston means in said pump chamber, and disabling means for disabling pumping of fluid by said pump means to a relatively high pressure fluid output during at least part of the time that said starter means is operative to start said power engine means.

7. The pump of claim 6, wherein said work transfer means comprises a rack and pinion assembly including a pair of racks linearly movable with respective piston means of said power engine means and pinion means for mechanically coupling said racks to limit mechanical movement thereof and of said opposed piston means to equal and opposite movement.

8. The pump of claim 1, further comprising a combustion chamber between said piston means, air compressor means responsive to movement of said piston means in a power stroke for compressing air, and flow path means for delivering such compressed air for supercharging said combustion chamber.

9. The pump of claim 8, said compressor means comprising a compressor piston integral with at least one of said piston means.

10. The pump of claim 9, wherein a combustion chamber is formed between said piston means, and said compressor means comprises connection means for directly connecting compressed air therefrom to said combustion chamber.

11. The pump of claim 10, said connection means and at least one of said piston means being cooperatively interrelated to enable said piston means to control delivery of compressed air from said connection means into said combustion chamber.

12. The pump of claim 1, wherein said supplemental linear engine means has a lower power density than said power engine means, and said work transfer means comprises means for effecting a compression stroke in said supplemental linear engine means during the power stroke of said power engine means, and starter means for delivering adequate input work to said power engine means to effect a sufficient compression stroke in said supplemental linear engine means for internal combustion to occur in the latter to provide a work input to effect a sufficient compression stroke in said power engine means for operation thereof.

13. The pump of claim 12, said pump means being operative during the power stroke of said power engine means for pumping fluid received at a relatively low pressure to a relatively high pressure fluid output, and further comprising disabling means for disabling pumping of fluid to such relatively high pressure fluid output during at least part of the time that said starter means is operative to start said power engine means.

14. The pump of claim 12, further comprising a combustion chamber between said piston means, air compressor means responsive to movement of said piston means in a power stroke for compressing air, and flow path means for delivering such compressed air for supercharging said combustion chamber, whereby in response to movement of said other piston means by said starter means such air is compressed in said compressor means to supercharge said combustion chamber for internal combustion in the first power stroke of said piston means.

15. The pump of claim 1, further comprising exhaust means for removing the products of combustion from said power engine means, and exhaust utilization means for producing a supplemental work output from the energy of such products of combustion.

16. The pump of claim 15, further comprising engine cooling means for providing a cooling output in response to such supplemental work output to cool said power engine means.

17. The pump of claim 16, said exhaust utilization means comprising a turbine, said engine cooling means comprising a liquid cooling system including a radiator, a liquid coolant, a coolant flow path, and a liquid pump, fan means for cooling said coolant in said radiator, and connecting means for connecting said turbine to said fan and liquid pump to operate the same.

18. The pump of claim 17, said exhaust utilization means further comprising afterburner means for delivering fuel to said products of combustion to increase the energy level thereof.

19. The pump of claim 15, further comprising auxiliary means for producing a useful power output, and clutch means for selectively coupling said auxiliary means to said exhaust utilization means after start-up of said power engine means.

* * * * *